United States Patent [19]

Primiano et al.

[11] Patent Number: 4,524,464

[45] Date of Patent: Jun. 25, 1985

[54] SAFETY GLOVE WITH MODIFIED DORSAL THUMB SPICA BRACE

[76] Inventors: George A. Primiano, 125 S. Green St., E. Stroudsburg, Pa. 18301; Frank P. Primiano, Jr., 4901 Hartley Dr., Lyndhurst, Ohio 44124

[21] Appl. No.: 650,629

[22] Filed: Sep. 14, 1984

[51] Int. Cl.[3] ..... A41D 19/00

[52] U.S. Cl. ..... 2/161 A; 2/17; 2/163; 128/87 A; 128/133

[58] Field of Search ..... 2/158, 159, 160, 161 R, 2/161 A, 162, 166, 16, 17, 20, 1, 2; 128/133, 87 A

[56] References Cited

U.S. PATENT DOCUMENTS

| | | | |
|---|---|---|---|
| 1,951,190 | 3/1934 | Gambee | 2/161 R |
| 2,388,330 | 11/1945 | Jungmann | 2/16 |
| 4,445,507 | 5/1984 | Eisenberg | 2/159 |

*Primary Examiner*—Louis K. Rimrodt
*Assistant Examiner*—Joseph S. Machuga
*Attorney, Agent, or Firm*—Ruth Moyerman

[57] ABSTRACT

A glove including a brace to prevent ulnar collateral ligament injuries to the thumb is disclosed. A pocket within the layers of the glove retains the brace. The brace is a modified dorsal thumb spica beginning distal to the wrist and extending generally to the end of the thumb. The brace extends across the dorsal side of the hand, allowing free range of motion of the metacarpophalangeal joints of the second through fifth digits. The brace terminates distally from the wrist on the palmar side proximate the palmar crease. The thumb portion is contoured to resist radial deviation and extension of the thumb, but permit flexion of the metacarpophalangeal and interphalangeal joints of the thumb towards the fingers.

19 Claims, 15 Drawing Figures

20
12
18
10
17
14
12
17
16

20
12

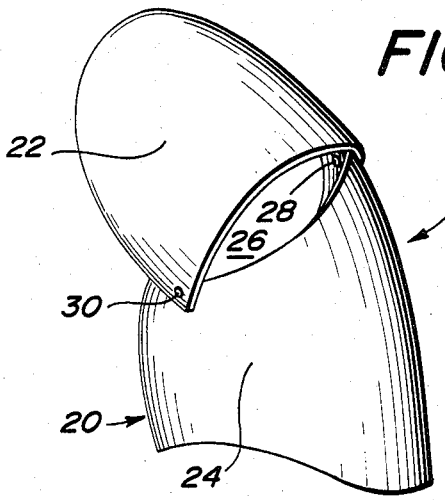
FIG. 8
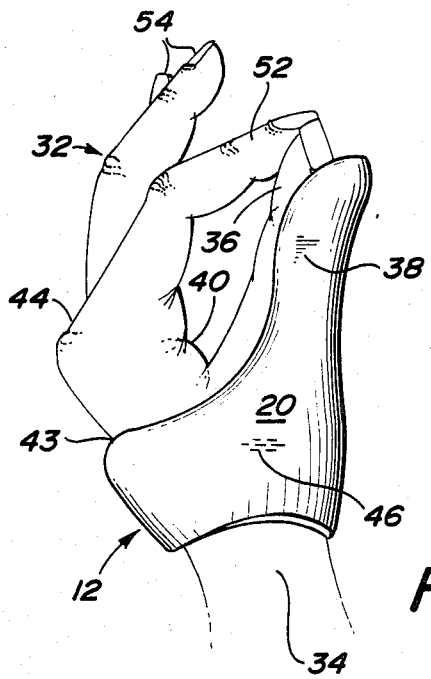
FIG. 5
FIG. 4
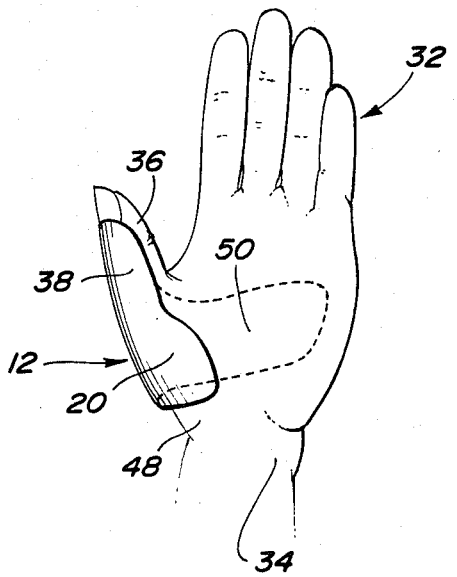

SAFETY GLOVE WITH MODIFIED DORSAL THUMB SPICA BRACE

BACKGROUND OF THE INVENTION

1. Field of the Invention

This invention relates to apparel, and more particularly to reinforced safety gloves.

2. Description of the Prior Art

It is a well known fact that snow skiers, whether engaged in competition or merely recreation, are prone to accidents that can be of a severe nature causing immobilization of various limbs for an extended period of time. Many devices are known to protect the skier from bodily injury, such as helmets for the head, goggles for the eyes, boots for the foot and ankle regions. Other protection devices limiting the danger of falling are safety bindings that release during a fall, and tip barriers to prevent crossing of skis.

All prior art devices aforementioned are of a preventative nature, thus serving to aid in the safe participation of a potentially dangerous sport.

Along with these previously mentioned prior art safety devices, there is also a great need to protect the parts of the hand that can be broken or injured while using that hand to break the force of a fall. Such a device would most logically be incorporated in the handwear. There heretofore has been an unsatisfied need that combines a serviceable ski glove and brace for prevention of common hand injuries sustained by skiers.

SUMMARY OF THE INVENTION

The aforementioned prior art problems are overcome by the reinforced safety glove of this invention. A glove, including a brace to prevent ulnar collateral ligament injuries involving the metacarpophalangeal joint of the thumb and adjacent bony structures, is disclosed. A pocket adapted to overfit and retain the brace within the glove is situated within the layers of the glove.

The brace is a modified dorsal thumb spica beginning distal to the wrist and extending generally to the end of the thumb, including the interphalangeal joint, thereby allowing flexion and extension of the wrist. The brace extends across the dorsal side of the hand at least proximate the ulnar border. The brace terminates distally from the wrist on the palmar side proximate the thenar crease, and on the dorsal side from at least proximate the junction of proximal two-thirds and distal one-third of the metacarpophalangeals, thus allowing free range of the motion of the metacarpophalangeal joints of the second through fifth digits.

The thumb portion is contoured to support the thumb to prevent dorsal radial displacement at the metacarpophalangeal joint and also the interphalangeal joint, so that a wearer may retain a pole-like object in his palm by opposition.

The device will decrease the instance of ulnar collateral ligament injuries involving the metacarpophalangeal joint of the thumb and adjacent bony structures for a wearer who attempts to break the force of his fall with an open hand.

It is, therefore, an object of this invention to provide a safety ski glove that will prevent the most prevalent hand injuries.

It is yet another object of this invention to provide a safety ski glove that does not inhibit the motion of the wrist joint, fingers or thumb.

It is still another object of this invention to provide a safety ski glove that allows the user the normal mobility of grasping his ski poles.

It is still a further object of this invention to provide a safety ski glove that, at the same time, is comfortable to wear, easily donned, and provides normal mobility.

These and other objects will be more readily ascertainable to one skilled in the art from a consideration of the following Figures, Description and exemplary embodiment.

BRIEF DESCRIPTION OF THE DRAWING(S)

FIG. 4 is a palmar view of the device of this invention omitting the glove and depicting the device around a left human hand.

FIG. 5 is a radial view of the device of this invention omitting the glove and depicting the device around a left human hand, showing the thumb and index finger touching.

FIG. 8 is a partial radial view of the device of this invention showing an alternate embodiment with the upper thumb portion hinged.

DETAILED DESCRIPTION OF THE PREFERRED EMBODIMENT(S)

Figures 1, 2, 3:
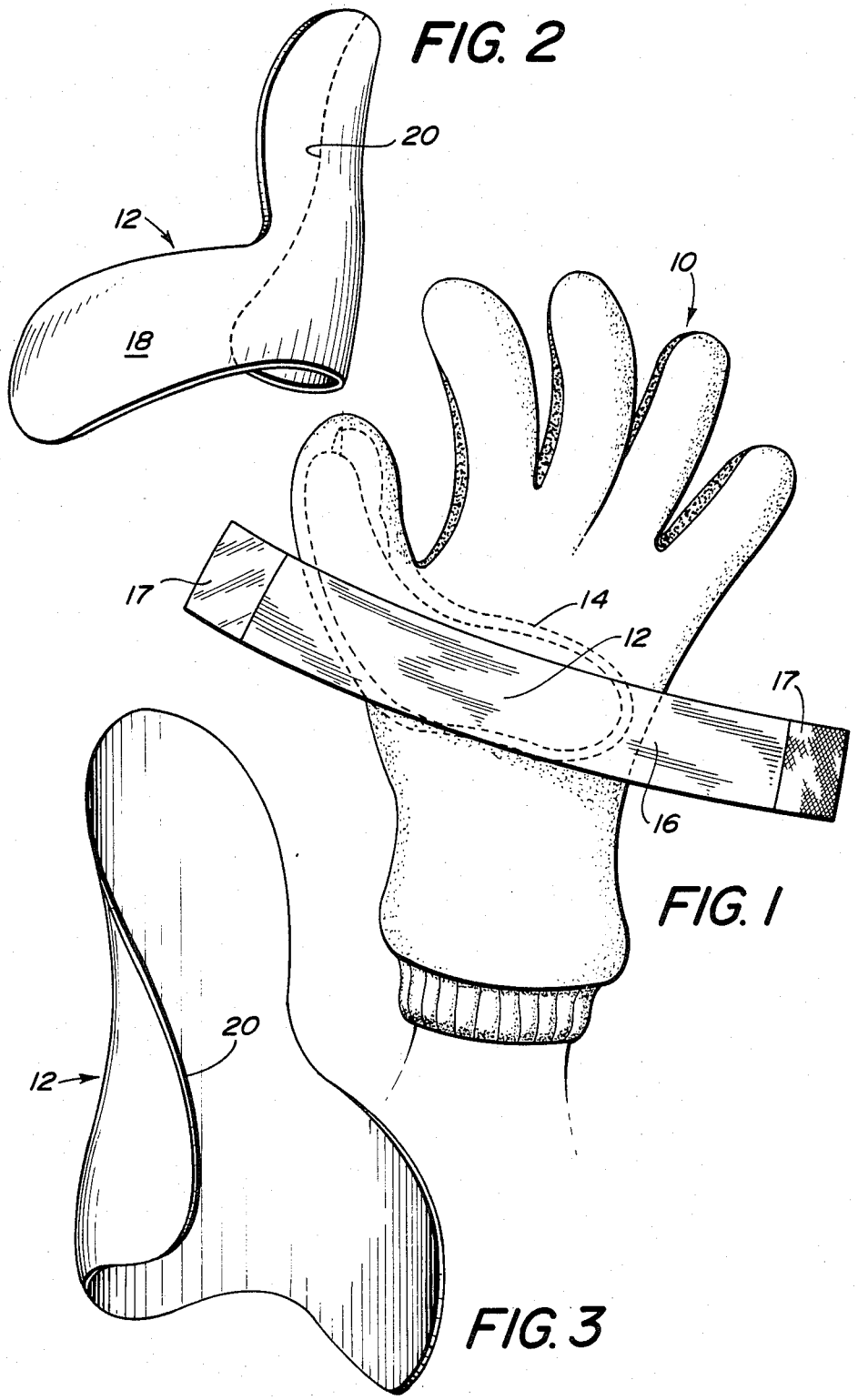
FIG. 1 depicts the device of this invention with the brace in phantom, fitting into the pocket in phantom of a right-handed glove.
FIG. 2 is a dorsal view of the device of this invention for the left hand, omitting the glove.
FIG. 3 is an inside dorsal view of the device of this invention for the left hand, omitting the glove.

Referring now to the drawings, and more particularly to FIG. 1, the device of this invention with the brace (in phantom), fitting into the pocket (in phantom) of a right-handed glove is depicted. Glove 10 retains brace 12 by pocket 14. The closing of strap 16 by Velcro tabs 17, while attached to glove 10, further stabilizes the retention of brace 12 within pocket 14 of glove 10 so that brace 12 will decrease the ulnar collateral ligament injuries involving the metacarpophalangeal joint of the thumb and adjacent bony structures of a wearer who is attempting to break the force of a fall with his open hand. This will be more fully discussed with reference to FIG. 5.

Referring now to FIG. 2, a top view of brace 12 for a left hand is shown, omitting the glove. Brace 12 is shown with dorsal side 18 and thumb portion 20. A detailed description of how brace 12 fits the human hand follows in reference to FIG. 5.

Referring now to FIG. 3, an inside dorsal view of brace 12 for a left hand is shown, omitting the glove. Brace 12 is shown with thumb portion 20. A detailed description of how brace 12 fits the human hand follows in reference to FIG. 4.

Referring now to FIG. 4, a palmar view of brace 12 for a left hand is shown, omitting the glove. Brace 12 fits around human hand 32 and terminates distally from wrist 34 on brace 12's palmar side 48, near thenar crease 50 of human hand 32. Thumb portion 20 begins distal to wrist 34 of human hand 32 and extends to generally the end of thumb 36, including thereby the interphalangeal joint indicated as 38.

Referring now to FIG. 5, a radial view of brace 12, omitting the glove, is shown depicting brace 12 around left human hand 32. Brace 12, fitting around hand 32, begins distal to wrist 34 and extends to about the end of thumb 36 including interphalangeal joint 38 (shown in phantom) of thumb 36, thereby allowing flexion and extension of wrist 34. Brace 12 extends dorsal to the lower portion of thumb index web space 40 of human hand 32 and extends across dorsal side 18 proximate ulnar border (not shown) of hand 32. Brace 12 terminates distally from dorsal side 18 at junction 43; junction 43 being proximal two thirds and distal one third of metacarpals (not shown) to allow free range of the motion of finger metacarpophalangeal joints 44 of hand 32. Thumb metacarpophalangeal, indicated at 46, and finger metacarpophalangeal 44 are now properly aligned.

Thumb portion 20 of brace 12 is shown contoured to prevent dorsal and radial displacement of human thumb 36 at thumb metacarpolphalangeal joint, indicated at 46, and also at the interphalangeal joint indicated at 38, so that a wearer may retain a pole-like object in his palm by the grasping together of thumb 36 with index finger 52 and remaining digits 54.

Figure 6:
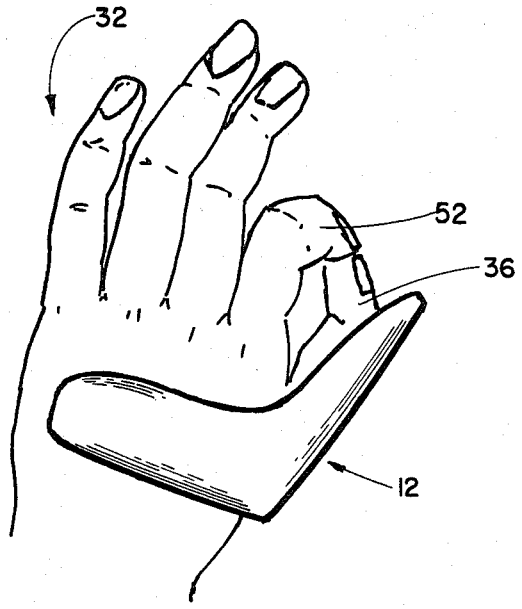
FIG. 6 is a dorsal view of the device of this invention omitting the glove and depicting the device around a left human hand, showing the thumb and index finger touching.

Referring now to FIG. 6, a dorsal view of brace 12, omitting the glove, is shown depicting brace 12 around human hand 32. Index finger 52 is shown flexed to contact thumb 36.

Figure 7:
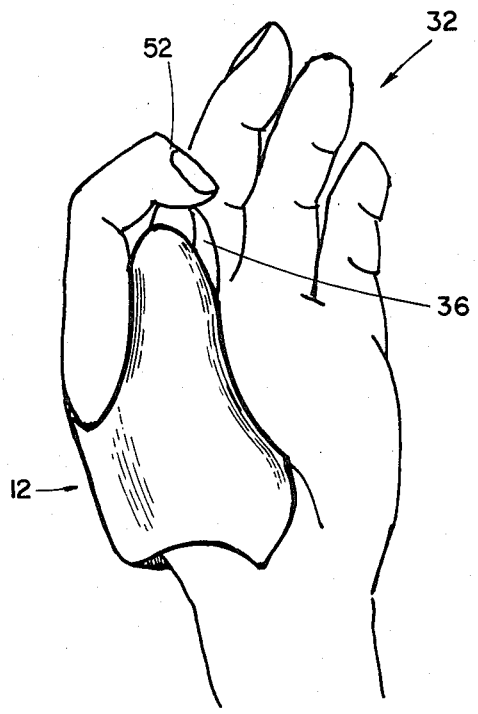
FIG. 7 is a radial palmar view of the device of this invention omitting the glove and depicting the device around a left human hand, showing the thumb, and index finger touching.

Referring now to FIG. 7, a radial palmar view of brace 12, omitting the glove, is shown depicting brace 12 around left human hand 32. Index finger 52 and thumb 36 are shown flexed so that they are in opposition with each other.

When the brace is incorporated in the glove, adequate space is given in the distal portion of the thumb part of the glove to allow for mobility of the thumb for grasping objects and touching the distal ends of the index through fifth fingers.

FIGS. 5, 6 and 7 altogether demonstrate the mobility of hand 32 in allowing the touching of thumb 36 to index finger 52 and remaining digits 54 while wearing brace 12.

Referring now to FIG. 8, a partial radial view of brace 12 is shown as an alternate embodiment with thumb portion 20 hinged and omitting the glove. Brace 12 shows pinned hinge open at 26 which is proximate the interphalangeal joint and allows brace 12 to bend with the thumb for grasping objects. Pins 28 and 30 are shown holding upper section 22 and lower section 24 of thumb portion 20 in an open flex, allowing for volar flexion of the thumb of a human hand and prevents hyperextension at the interphalangeal joint of the thumb.

Figure 9:
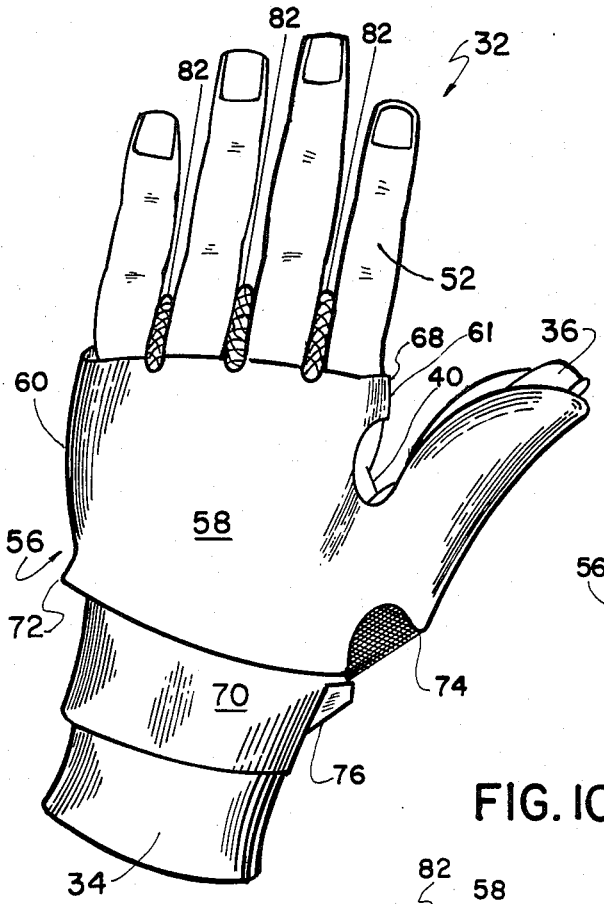
FIG. 9 is a dorsal view of an alternate embodiment of the device of this invention depicting the device with cuff and encompassing a human left hand.
Figure 11:
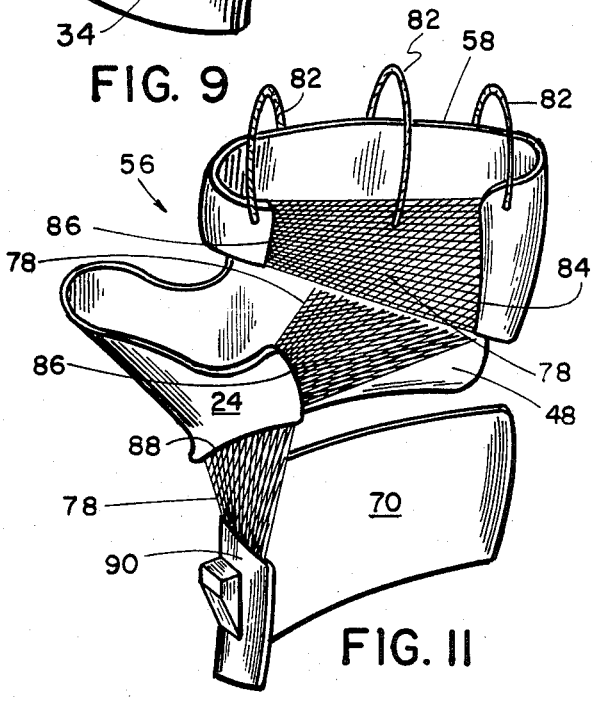
FIG. 11 is a palmar view of an alternate embodiment of the device of this invention showing the cuff and retaining means and omitting the human hand.

Referring now to FIG. 9, a dorsal view of another alternate embodiment is shown depicting the device and a cuff encompassing left human hand 32. Brace 56 is now shown to further extend across on dorsal side 58 to and around ulnar border 60 to proximate the palmar side (as shown in FIG. 11) of the fifth metacarpophalangeal joint of human hand 32. As will be seen in FIG. 11, brace 56 also continues around radial border 61 of index finger 52 to proximate the second metacarpophalangeal joint of palmar side of human hand 32. Brace 56 terminates distally on dorsal side 58 proximately level with metacarpophalangeal border 68. Reinforcing strips 82 are seen in top view.

Dorsal wrist cuff 70 is shown with its radial buttress 76, while brace 56 is shown with ulnar border outward flange 72 and thumb outward flange 74. Flange 72 of brace 56, in cooperation with cuff 70, is intended to limit ulnar deviation of hand 32 within an acceptable noninjurious range. Flange 74 of brace 56, in cooperation with cuff 70's buttress 76, is intended to limit the radial deviation of hand 32 within an acceptable noninjurious range.

A decrease in the incidence of ulnar collateral ligament injuries involving the metacarpophalangeal joint of the thumb and adjacent bony structures is intended by the restricted motion just discussed.

Figure 10:
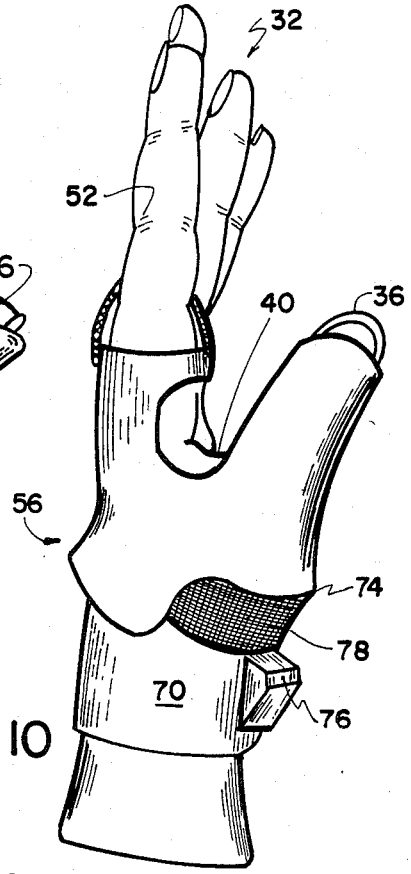
FIG. 10 is a radial view of an alternate embodiment of the device of this invention depicting the device with cuff and encompassing a human left hand.

Referring now to FIG. 10, a radial view of alternate embodiment 56 of the device of this invention is shown depicting brace 56 with cuff 70 encompassing human left hand 32. In this view, cuff 70 and brace 56 are joined by being attached to webbed retaining means 78, thereby holding cuff 70 and brace 56 in the desired relative positions to one another. Radial buttress 76 of cuff 70, and flange 74 of brace 56 cooperatively work to limit hand 32 from extreme radial deviation by their contact; all such contacts intended to thereby limit serious injury to the wrist.

Referring now to FIG. 11, a palmar view of alternate embodiment 56 of the device of this invention is shown to better depict cuff 70 and retaining means 78. Retaining means 78 includes attached reinforcing strips 82 running from palmar side 48 of brace 56 to dorsal side 58 of brace 56, thereby limiting motion of brace 56 relative to the hand. Reinforcing strips 82 are shown shaded in some views and unshaded in others for ease of depiction.

Retaining means 78 is also shown to span palmar side 48 of brace 56. Webbed retaining means 78 spans brace 56 from its ulnar palmar border 84 to its radial palmar border 86 and is attached thereto. Additionally, webbed retaining means 78 spans brace 56 from its ulnar palmar border 84 to its lower thumb portion 24 at its radial palmar border 86 and is attached thereto. Lower thumb portion 24 and cuff 70 are attached to webbed retaining means 78 at their respective radial borders 88 and 90 so that brace 56 and cuff 70 remain appropriately positioned relative to each other.

Figure 12:
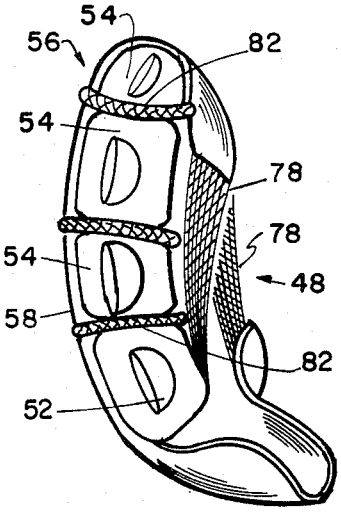
FIG. 12 is a top view of FIG. 9, omitting the cuff, showing only the top half of the hand and omitting the wrist to more clearly show the retaining means between the second through fifth digits.

Referring now to FIG. 12, a top view of FIG. 9, omitting the cuff, showing only the top half of the hand and omitting the wrist, more clearly shows strips 82 of brace 56 connected and reaching between index finger 52 and remaining digits 54 from palmar side 48 to dorsal side 58, thereby limiting motion of brace 56 relative to the hand.

Figure 13:
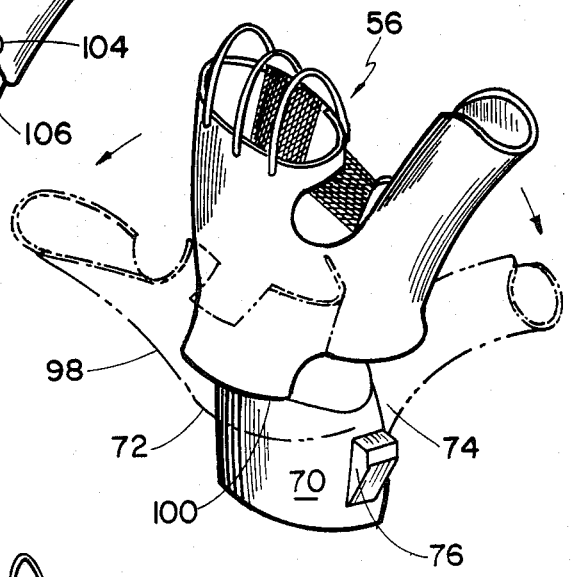
FIG. 13 is a diagramatic view of an alternate embodiment of the device of this invention showing the limiting of the outside-to-inside and back-to-front range of motion of the device.

Referring now to FIG. 13, a diagramatic view of alternate embodiment 56 is illustrated to show the excursion of the outside-to-inside (radial to ulnar) and back-to-front (dorsal to palmar) range of motion of the device. Cuff 70 limits the radial rotation of brace 56 when brace 56's outward flange 74 impinges upon radial buttress 76 of cuff 70. Cuff 70 also limits the ulnar rotation of brace 56 when brace 56's outward ulnar border flange 72 impinges upon cuff 70 at its ulnar border 98.

Dorsiflexion of brace 56 is also suppressed by the impinging of brace 56's lower border 100 onto cuff 70; the impinging thereby limiting movement that could cause injury to the wrist joint.

Figure 14:
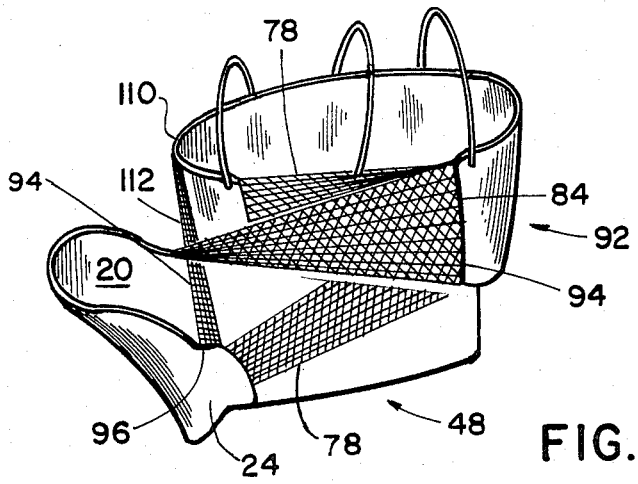
FIG. 14 is a palmar view of another alternate embodiment of the device of this invention omitting the human hand and showing additional retaining means.

Referring now to FIG. 14, a palmar view of another alternate embodiment 92, omitting the hand, is shown with additional retaining means. In this view, additional retaining means 94 spans brace 92 from its outer upper radial edge 110 to its lower thumb portion 24 as indicated at 96 on palmar side 48.

Additional retaining means 94 also spans brace 92 from ulnar border 84 to thumb portion 20 as indicated at 112. Additional webbing 94, along with initial retaining means 78, provides still further means to limit motion of brace 92 relative to the hand.

Figure 15:
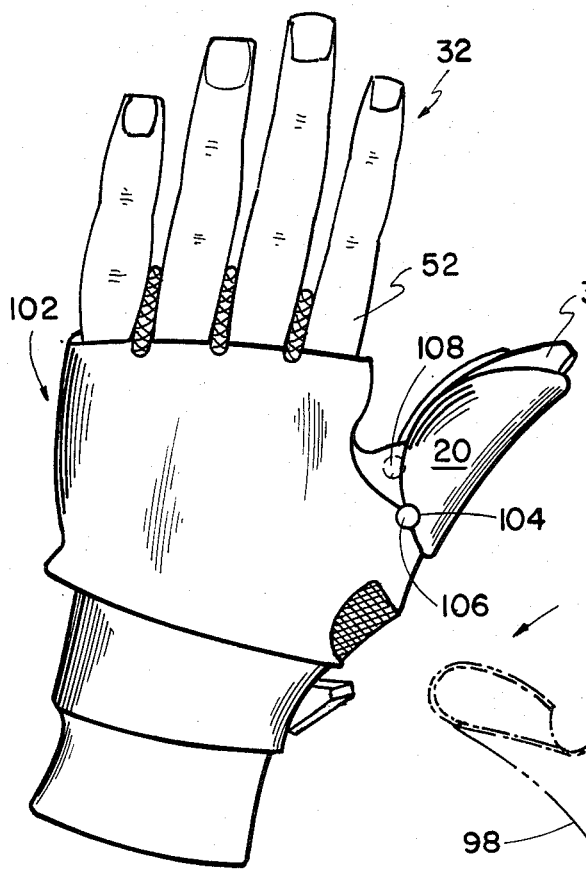
FIG. 15 is a dorsal view of an alternate embodiment of the device of this invention depicting the device with the lower thumb portion hinged at the metacarpolphangeal joint.

Referring now to FIG. 15, a dorsal view of brace 102 is shown with additional hinge means 104 at the metacarpophalangeal joint. Pins 106 and 108 (in phantom) are shown joining thumb section 20 to brace 102, thereby allowing additional palmar flexing of human thumb 36.

There are many variations which may be practiced within the scope of this invention. It should be noted that, although the general contour and flexion is illustrated, it is by no means meant to be limiting as long as they fulfill their intended purpose of decreasing hand injury.

While a glove casing is illustrated, it is merely preferred and any hand covering which would accomplish this purpose is within the scope of this invention.

Furthermore, while a pinned hinge is illustrated, it is merely preferred and any connecting means which accomplishes the purpose is within the scope of this invention.

While a pocket for retaining the brace is illustrated, it is not critical as the glove may serve to retain the brace and still be within the scope of the invention.

While a strap is illustrated, it is not critical, but merely a suggested attachment.

While webbing designs are illustrated, they are merely a suggestion and not critical to the scope of the invention.

While a nonrigid webbing is suggested, a rigid webbing could be substituted and still be within the scope of this invention.

While the retaining means is illustrated as being connected to the brace, it could be incorporated within the glove and still be within the scope of this invention.

While a thumb flange is illustrated, it is merely a suggested improvement and not critical to the scope of this invention.

While a wrist cuff buttress is illustrated, it is merely a suggested improvement and not critical to the scope of this invention.

While an ulnar border flange is illustrated, it is merely a suggested improvement and not critical to the scope of this invention.

The device of this invention has many advantages. Chiefly among these is that the safety ski glove wll decrease the incidence of prevalent injuries to the hand.

Secondly, the safety ski glove does not significantly limit normal motion of the wrist, fingers and thumb joints.

Thirdly, the safety ski glove allows the user mobility for grasping ski poles in his hand.

Fourth, while the safety glove has been discussed as a preventative use for skiers, the glove could be used for various other sports such as hockey, lacrosse and polo.

Lastly, while the preferred use is to decrease injury, the glove can be used as a safety measure for one already having sustained a hand injury.

Having now illustrated and described our invention, it is not intended that such description limit this invention, but rather than this invention be limited to only a reasonable interpretation of the appended claims.

What is claimed is:

1. In a reinforced glove adapted to overfit the human hand including at least an inner layer for the engagement of the human hand and an outer layer for protection of the human hand, an improvement comprising:

(a) a modified dorsal thumb spica brace beginning distal to the wrist and extending to generally the end of the thumb including the interphalangeal joint of said thumb, thereby allowing flexion and extension of said wrist, said brace extending across said dorsal side of said hand at least proximate the ulnar border, said brace terminating distally from said wrist on the palmar side proximate the palmar crease, and on said dorsal side proximate the junction of proximal two-thirds and distal one-third of the metacarpals thus allowing free range of motion of the metacarpophalangeal joints of the second through fifth digits, said thumb portion also contoured to prevent thumb hyperextension at said metacarpophalangeal joint, and at said interphalangeal joint of said thumb, so that a wearer may retain a pole-like object in his palm by opposition; and, (b) a pocket adapted to overfit and retain said brace between said inner and said outer layer, whereby said brace will decrease the ulnar collateral ligament injuries involving the metacarpophalangeal joint of the thumb and adjacent bony structures of a wearer who is attempting to break the force of a fall with his open hand.

2. The glove according to claim 1 wherein said glove also includes an adjustable outer strap proximate said pocket of part (b) to further aid in retaining said brace of part (a) in its proper position.

3. The glove according to claim 2 wherein said strap is adjusted by a fastener sufficiently strong enough to withstand forces along the plane of the strap.

4. The glove according to claim 1 wherein said brace of part (a) is a suitable moldable material.

5. The glove according to claim 1 wherein said thumb portion of part (a) includes a hinge means proximate said interphalangeal joint.

6. The glove according to claim 5 wherein said hinged means is pinned.

7. The glove according to claim 1 wherein said brace of part (a) further extends across said dorsal side of said hand continuing around said ulnar border proximate said fifth metacarpophalangeal joint said palmar side and said brace continuing around said dorsal side of the index finger from said dorsal side to said palmar side proximate said second metacarpophalangeal joint, and said brace terminating distally from said wrist on said dorsal side level with said distal third of the metacarpals.

8. The glove according to claim 7 wherein a retaining means spans said palmar side of said brace from proximate said dorsal to said ulnar border; said retaining means also spanning between each said second through said fifth digits from said palmar side to said dorsal side so that motion of said brace is prevented.

9. The glove according to claim 7 wherein said brace includes, additionally, a detachable dorsal forearm wrist cuff.

10. The glove according to claim 9 wherein said cuff is attached to said retaining means so that said cuff is maintained within a predetermined area and position.

11. The glove according to claim 9 wherein said dorsal forearm cuff includes, additionally, a distal radial buttress.

12. The glove according to claim 7 wherein said glove also includes an adjustable outer strap proximate said brace to further aid in retaining said brace in its proper position.

13. The glove according to claim 12 wherein said strap is adjusted by a fastener.

14. The glove according to claim 7 wherein said brace, distal from said wrist, includes an outward flange proximate said ulnar border.

15. The glove according to claim 7 wherein said retaining mean is flexible webbing.

16. The glove according to claim 1 wherein said thumb portion of part (a) includes an outward flange proximate below said metacarpophalangeal joint.

17. The glove according to claim 1 wherein said thumb portion of said brace includes a hinge means proximate said metacarpophalangeal joint.

18. The glove according to claim 17 wherein said hinge is pinned.

19. In a reinforced glove adapted to overfit the human hand including at least an inner layer for the engagement of the human hand and an outer layer for the protection of the human hand, an improvement comprising:

(a) a modified dorsal thumb spica brace beginning distal to the wrist and extending to generally the end of the thumb including the interphalangeal joint of said thumb, thereby allowing flexion and extension of said wrist, said brace extending across said dorsal side of said hand continuing around said ulnar border proximate said fifth metacarpophalangeal joint said palmar side and said brace continuing around said radial side of said index finger from said radial side to said palmar side proximate said second metacarpophalangeal joint and said brace terminating distally from said wrist on said dorsal side just below the level of the said metacarpophalangeal joints, thus allowing free range of the motion of the metacarpophalangeal joints of the second through fifth digits, said thumb portion including an outward flange proximate below said metacarpophalangeal joint, said thumb portion also contoured to allow said thumb to rest in a balanced position and also prevent hyperextension of said metacarpophalangeal joint and said interphalangeal joint of said thumb and also allow sufficient flexion to permit the wearer to hold a pole-like object in his grasp;

(b) a dorsal forearm wrist cuff, including a distal radial buttress, said brace and said cuff attached to (c) a retaining means spanning said palmar side of said brace from proximate said dorsal to said ulnar border, said retaining means also spanning between each said second through said fifth digits from said palmar side to said dorsal side so that rotation of said brace is prevented, and, (d) a pocket adapted to overfit and retain said brace, said dorsal forearm wrist cuff and said retaining means, whereby the brace will decrease ulnar collateral ligament injuries involving the metacarpophalangeal joint of the thumb and adjacent bony structures of a wearer who is breaking the force of a fall with his open hand.

* * * * *